US006688277B1

(12) United States Patent
Mahr et al.

(10) Patent No.: US 6,688,277 B1
(45) Date of Patent: Feb. 10, 2004

(54) FUEL INJECTION SYSTEM FOR AN INTERNAL COMBUSTION ENGINE

(75) Inventors: Bernd Mahr, Plochingen (DE); Martin Kropp, Korntal-Muenchingen (DE); Hans-Christoph Magel, Pfullingen (DE); Wolfgang Otterbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 276 days.

(21) Appl. No.: 09/807,881

(22) PCT Filed: Aug. 2, 2000

(86) PCT No.: PCT/DE00/02581

§ 371 (c)(1),
(2), (4) Date: Aug. 20, 2001

(87) PCT Pub. No.: WO01/14727

PCT Pub. Date: Mar. 1, 2001

(30) Foreign Application Priority Data

Aug. 20, 1999 (DE) ..... 199 39 423

(51) Int. Cl.[7] ..... F02B 3/00
(52) U.S. Cl. ..... 123/299; 123/446
(58) Field of Search ..... 123/446, 467, 123/299, 300

(56) References Cited

U.S. PATENT DOCUMENTS

| | | | | | |
|---|---|---|---|---|---|
| 4,142,497 | A | * | 3/1979 | Long | 123/456 |
| 4,811,899 | A | | 3/1989 | Egler | |
| 5,355,856 | A | * | 10/1994 | Paul et al. | 123/446 |
| 5,622,152 | A | * | 4/1997 | Ishida | 123/446 |
| 6,513,497 | B1 | * | 2/2003 | Mahr et al. | 123/447 |

FOREIGN PATENT DOCUMENTS

| | | |
|---|---|---|
| DE | 41 18 237 A1 | 12/1991 |
| DE | 197 16 221 A1 | 10/1998 |
| DE | 199 10 970 A1 | 9/2000 |
| EP | 0 711 914 A1 | 5/1996 |
| WO | WO 98/09068 | 3/1998 |

* cited by examiner

*Primary Examiner*—Mahmoud Gimie
(74) *Attorney, Agent, or Firm*—Ronald E. Greigg

(57) ABSTRACT

In a fuel injection system for an internal combustion engine, in which fuel at at least two differently high fuel pressures can be injected via injectors into the combustion chamber of the engine, parallel to a bypass line a hydraulic pressure booster is provided for generating the higher fuel pressure; the pressure booster is actuatable and deactuatable via a valve unit. Since the pressure booster is not constantly in operation, and the losses from friction are also reduced, the efficiency is improved.

28 Claims, 7 Drawing Sheets

FUEL INJECTION SYSTEM FOR AN INTERNAL COMBUSTION ENGINE

CROSS-REFERENCE TO RELATED APPLICATIONS

This application is a 35 USC 371 application of PCT/DE 00/02581 filed on Aug. 02, 2000.

BACKGROUND OF THE INVENTION

1. Field of the Invention

The invention is based on a fuel injection system for an internal combustion engine.

2. Description of the Prior Art

One injection system of the type with which this invention is concern has been disclosed by European Patent Disclosure EP 0 711 914 A1, for instance.

For better comprehension of the ensuing description, several terms will first be defined in more detail: In a pressure-controlled fuel injection system, a valve body (such as a nozzle needle) is opened counter to the action of a closing force by the fuel pressure prevailing in the nozzle chamber of an injector, and thus the injection opening is uncovered for an injection of the fuel. The pressure at which fuel emerges from the nozzle chamber into the cylinder is called the injection pressure. The term stroke-controlled fuel injection system is understood in the context of the invention to mean that the opening and closing of the injection opening of an injector takes place with the aid of a displaceable valve member on the basis of the hydraulic cooperation of the fuel pressures in a nozzle chamber and in a control chamber. An arrangement is furthermore described below as central when it is provided jointly for all the cylinders, and as local if it is intended for only a single cylinder.

In the pressure-controlled fuel injection system known from EP 0 711 914 A1, with the aid of a high-pressure pump, fuel is compressed to a first, high fuel pressure of about 1200 bar and stored in a first pressure reservoir. The fuel that is at high pressure is also pumped into a second pressure reservoir, in which by regulation of its fuel delivery using a 2/2-way valve, a second high fuel pressure of about 400 bar is maintained. Via a central valve control unit, either the lower or the higher fuel pressure is carried into the nozzle chamber of an injector. There, by means of the pressure, a spring-loaded valve body is lifted from its valve seat, so that fuel can emerge from the nozzle opening.

A disadvantage of this known fuel injection system is that first all the fuel must be compressed to the higher pressure level, so that then some of the fuel can be relieved to the lower pressure level again. Furthermore, two pressure reservoirs are needed for storing the two fuel pressures. The high-pressure pump, since it is driven by the engine camshaft, is constantly in operation, even when the desired pressure in the applicable pressure reservoir has already been reduced. This constant generation of high pressure and the ensuing relief to the low pressure level are contrary to improved efficiency. When high-pressure reservoirs are used, the fuel pressure is at present limited to a maximum of about 1800 bar, for reasons of strength.

From International Patent Disclosure WO 98/09068, a stroke-controlled injection system is known in which once again two pressure reservoirs are provided for storing the two fuel pressures. For each pressure reservoir, its own high-pressure pump is provided, which is constantly in operation, even when the desired pressure in the applicable pressure reservoir has already been decreased.

SUMMARY OF THE INVENTION

To improve the efficiency, according to the invention a second, higher pressure level is generated by means of a pressure booster. Since this boosted pressure is not stored in a pressure reservoir, a higher injection pressure can be achieved. The two pressure levels can be used to define a flexible injection, such as a boot injection, pre-injection and post-injection.

Further advantages and advantageous features of the subject of the invention can be learned from the description, drawing and claims.

BRIEF DESCRIPTION OF THE DRAWING

Various exemplary embodiments of fuel injection systems of the invention with a hydraulic pressure booster unit, in which fuel is injected at two differently high fuel pressures, are described below and illustrated in the drawings, in which.

DESCRIPTION OF THE PREFERRED EMBODIMENTS

Figure 1A:
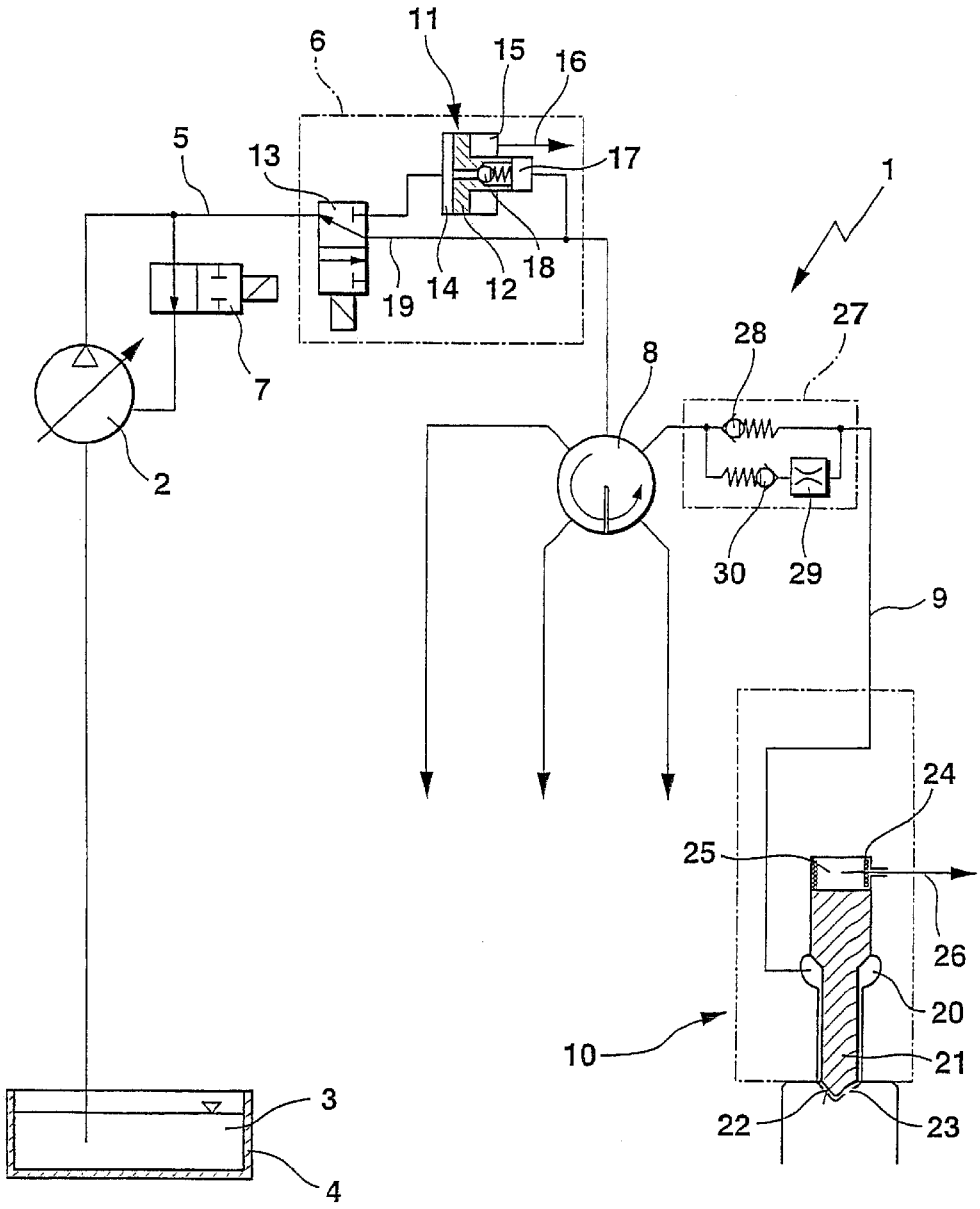
FIGS. 1*a* and 1*b* are schematic illustrations of a first fuel injection system with pressure-controlled injectors and a central pressure booster unit.

In the first exemplary embodiment, shown in FIG. 1*a*, of a pressure-controlled fuel injection system 1, a high-pressure pump 2 pumps fuel 3 out of a tank 4 via a feed line 5 to a central pressure booster unit 6 at high pressure, which is built up by supplying electric current to a 2/2-way valve 7. The high-pressure pump 2 can generate a first (lower) fuel pressure of about 300 to about 100 bar and by way of example can be a cam pump with an injection adjuster, similar to the distributor injection pump known from German Patent Disclosure DE 35 16 867 A1.

Via the central pressure booster unit 6, a still higher fuel pressure can be generated as needed. By utilizing wave propagation effects, an injection pressure of over 2000 bar can be achieved. Whatever fuel pressure prevails is then distributed by a central distributor device 8 to a plurality of high-pressure lines 9, corresponding to the number of individual cylinders, which lead away to the various injectors 10 (injection devices) protruding into the combustion chambers of the internal combustion engine to be supplied. In FIG. 1, only one of the injectors 10 is shown in detail.

The central pressure booster unit 6 includes a pressure booster 11 with a pressure means 12 in the form of a displaceable piston element, which can be connected by one end, with the aid of a valve unit 13, to the feed line 5, so that on one end it is subjected to pressure by means of the fuel located in a primary chamber 14. A differential chamber 15 is pressure-relieved by means of a leakage line 16, so that the pressure means 12 can be displaced in the compression direction to reduce the volume of a pressure chamber 17. As a result, the fuel located in the pressure chamber 17 is compressed to the higher fuel pressure, in accordance with the ratio of the areas of the primary chamber 14 and pressure chamber 17. The filling of the pressure chamber 17 is done via a check valve 18 provided in the pressure chambers 17. The pressure booster 11 can be circumvented by a parallel bypass line 19, which is actuatable and deactuatable by means of the valve unit 13. In FIG. 1*a*, the valve unit 13 is embodied as a 3/2-way valve upstream of the pressure booster 11. The parts 11, 13 and 19 form the central pressure booster unit 6.

Whatever fuel pressure prevails at the distributor device 8 is carried via the pressure line 9 into a nozzle chamber 20 of the injector 10. The injection takes place under pressure control, with the aid of a pistonlike valve member 21 (nozzle needle), which is axially displaceable in a guide bore and whose conical valve sealing face 22 cooperates with a valve seat face on the injector housing and thus closes the injection openings 23 provided there. Inside the nozzle chamber 20, a pressure face of the valve member 21, pointing in the opening direction of the valve member 21, is exposed to the pressure that prevails there, and the nozzle chamber 20 continues up to the valve sealing face 22 of the injector 10, via an annular gap between the valve member 21 and the guide bore. By means of the pressure prevailing in the nozzle chamber 20, the valve member 21 that seals off the injection openings 23 is opened counter to the action of a closing force (closing spring 24); the spring chamber 25 is pressure-relieved by means of a leakage line 26. Downstream of the distributor device 8, one check valve assembly 27 for each injector 10 is also provided; this assembly admits the fuel in the direction of the injector 10 via a first check valve 28 and allows the return flow of fuel from the injector 10 by means of a throttle 29 and a second check valve 30, for relief of the distributor device 8 and for pressure reduction.

A pre-injection at the lower fuel pressure takes place by supplying current to the 2/2-way valve 7, while the valve unit 13 is currentless. Supplying current to the valve unit 13 as well then effects the main injection at the higher fuel pressure. For a post-injection at the lower fuel pressure, the valve unit 13 is switched back into the currentless state. If with the aid of the valve unit 13, with the 2/2-way valve 7 currentless, the primary chamber 14 is connected to the entrance to the high-pressure pump 2, the result is the restoration of the pressure means 12 and the refilling of the pressure chamber 17, which is connected to the feed line 5 via the check valve 18. Because of the pressure ratios in the primary chamber 14 and the pressure chamber 17, the check valve 18 opens, so that the pressure chamber 17 is at the fuel pressure of the high-pressure pump 2, and the pressure means 12 is returned hydraulically to its outset position. To improve the restoration performance, one or more springs can be disposed in the chambers 14, 15 and 17.

Figure 1B:
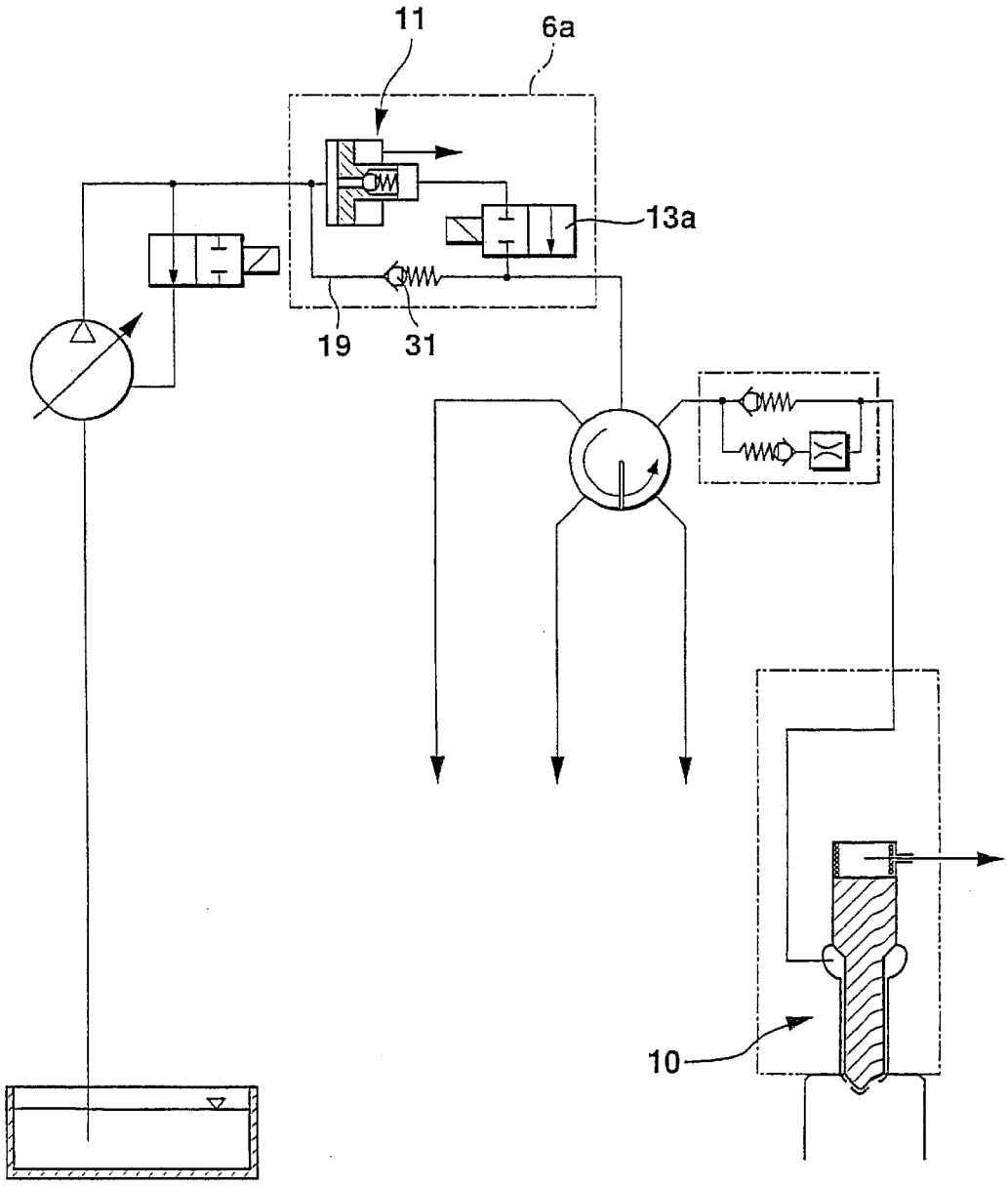

In FIG. 1*b*, the valve unit 13*a* is embodied downstream of the pressure booster 11 and in the form of a 2/2-way valve, which is decoupled from the bypass line 19 via a check valve 31. The parts 11, 13*a*, 19 and 31 form the central pressure booster unit 6*a*.

In the description of the other drawing figures, only the distinctions from the fuel injection system of FIG. 1 will be addressed below. Identical or functionally identical components are identified by the same reference numerals and will not be described again in detail.

Figure 2:
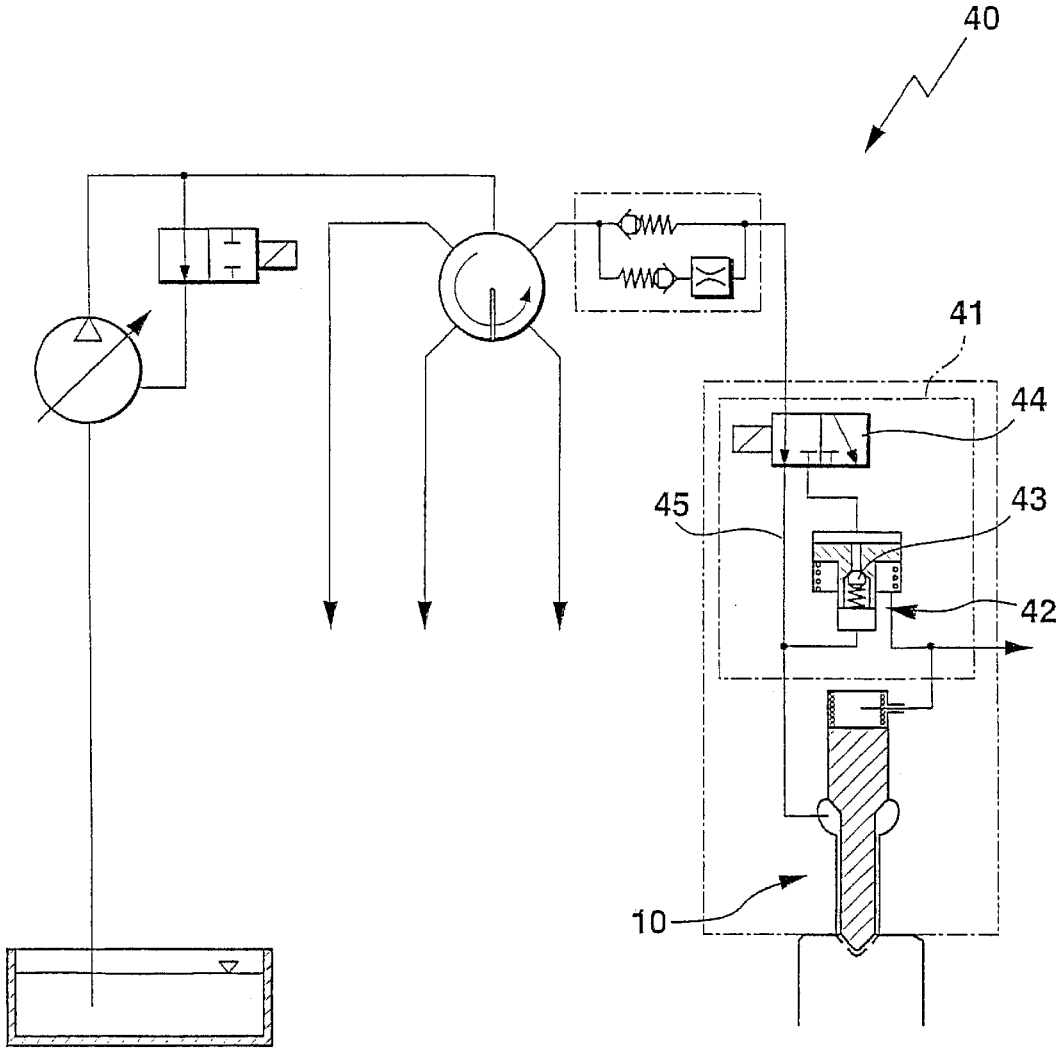
FIG. 2, illustrates a second injection system with pressure-controlled injectors and also with one local pressure booster unit provided for each injector.

In the injection system 40 shown in FIG. 2, the pressure booster unit 41 is not connected centrally but instead locally for each injector 10 individually. The local pressure booster unit 41, like the central pressure booster unit 6 shown in FIG. 1*a*, includes a pressure booster 42 with a check valve 43 as well as a valve unit 44 for switching over between the pressure booster 42 and the bypass line 45.

Figure 3A:
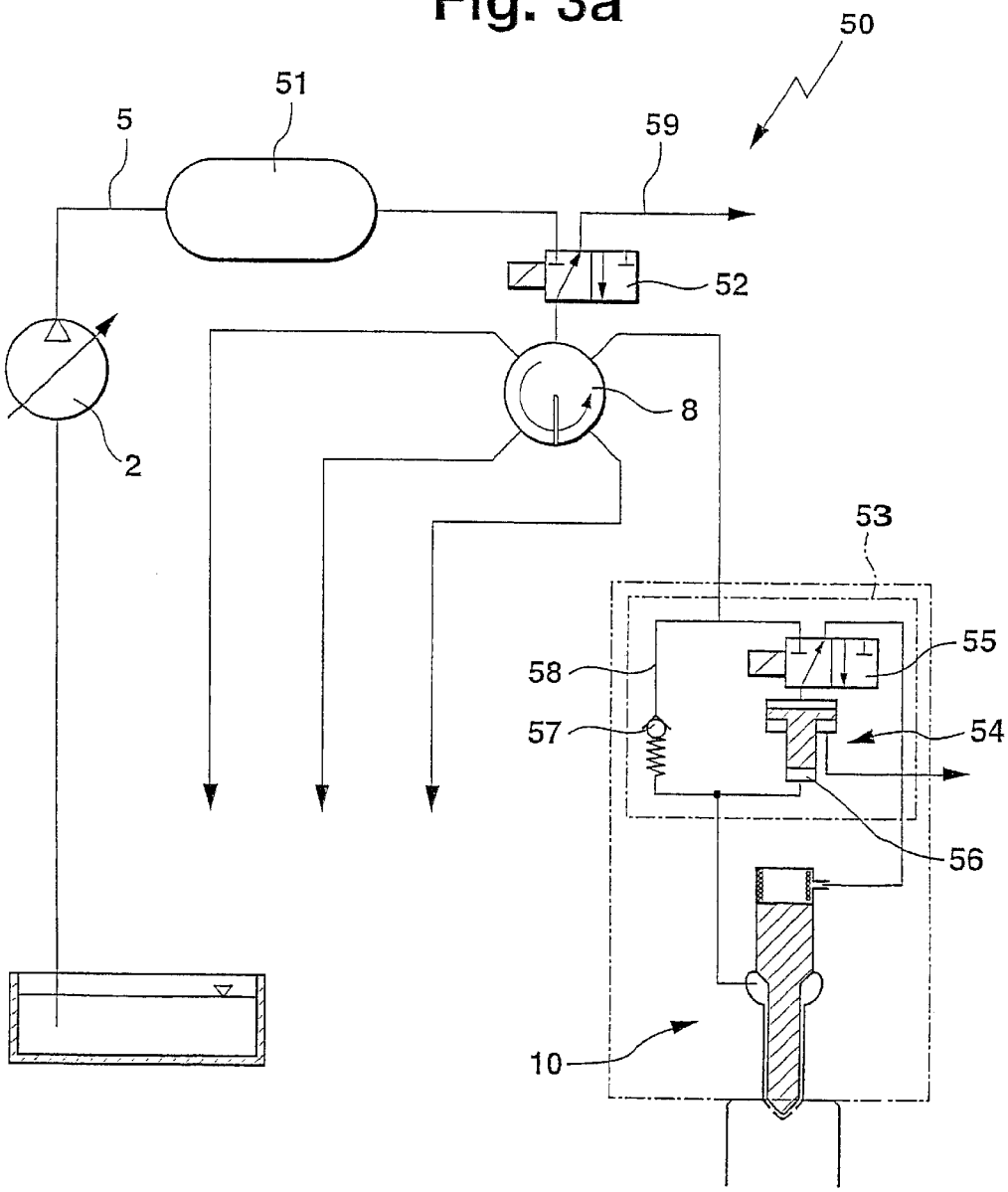
FIGS. 3*a* and 3*b* illustrates a third injection system with pressure-controlled injectors, and with one modified local pressure booster unit for each injector.
Figure 3B:
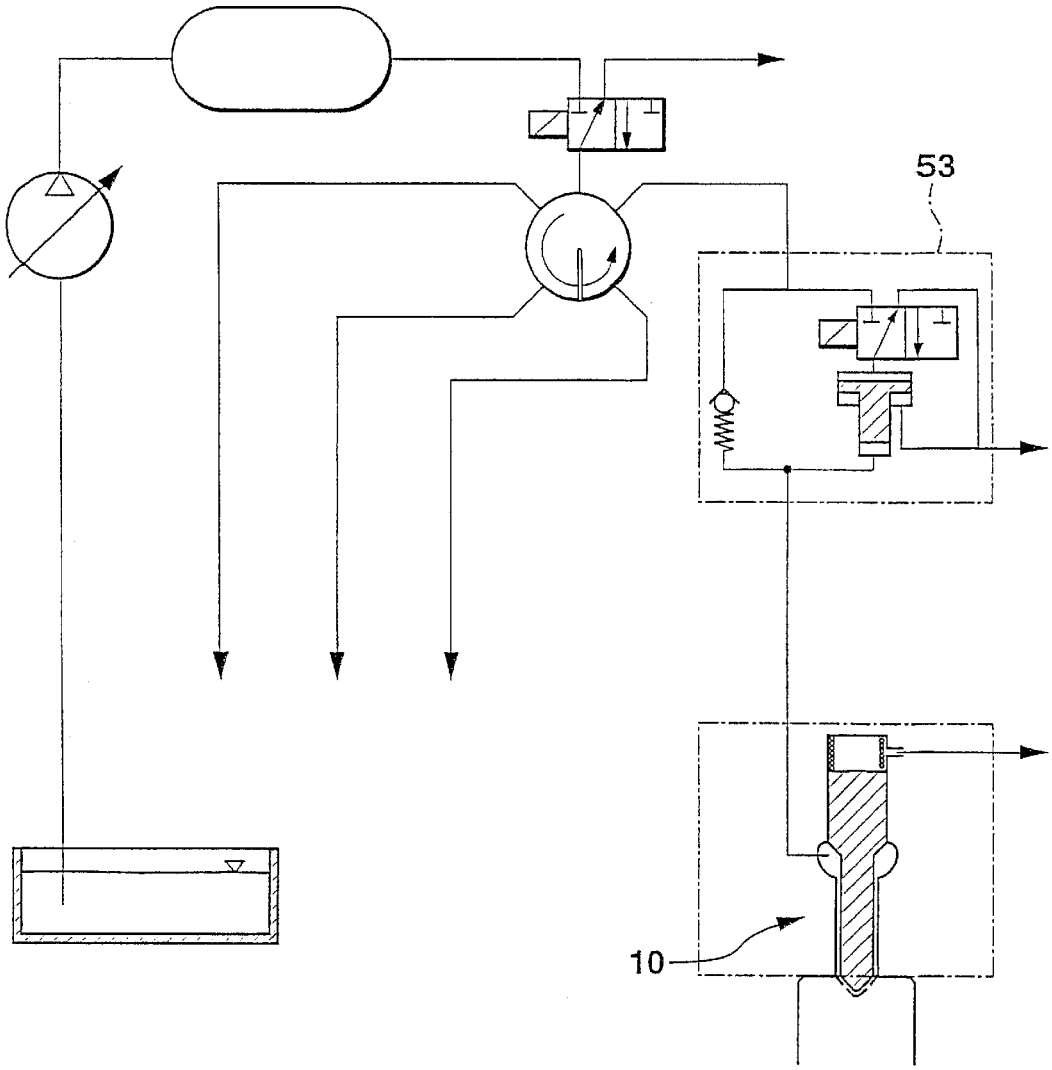

In the injection system 50 shown in FIG. 3, the high-pressure pump 2 pumps the fuel via the feed line 5 into a central pressure reservoir 51 (common rail), in which the fuel is stored at a pressure of about 300 to about 600 bar. Under the control of a central valve unit 52 (such as a 3/2-way valve), the fuel is carried onward from the pressure reservoir 51 via the central distributor device 8 to the individual pressure-controlled injectors 10. Each injector 10 is assigned a local pressure booster unit 53 with a pressure booster 54, by means of which, as needed, a higher fuel pressure can be generated from the lower fuel pressure of the pressure reservoir 51. Via the valve unit 55 (3/2-way valve), the local pressure booster 54, which is constructed analogously to the central pressure booster 11, can be actuated. The pressure chamber 56 of the local pressure booster 54 is filled with fuel from the pressure reservoir 51, and a check valve 57 in a bypass line 58 parallel to the pressure booster 54 prevents the return of compressed fuel back into the pressure reservoir 51. The parts 54, 55, 57 and 58 form the local pressure booster unit 53, which can be located either inside the injector housing (FIG. 3*a*) or outside it (FIG. 3*b*).

A pre-injection at the lower fuel pressure of the central pressure reservoir 51 takes place with the valve unit 55 currentless, as a result of supplying current to the central 3/2-way valve 52. By supplying current to the valve unit 55 as well, the main injection is then effected at the higher fuel pressure. For a post-injection at the lower fuel pressure, the valve unit 55 is switched back into the currentless state again. At the end of the injection, the central valve unit 52 is switched back to leakage line 59, and thus the distributor device 8 and the injector 10 are relieved.

Figure 4A:
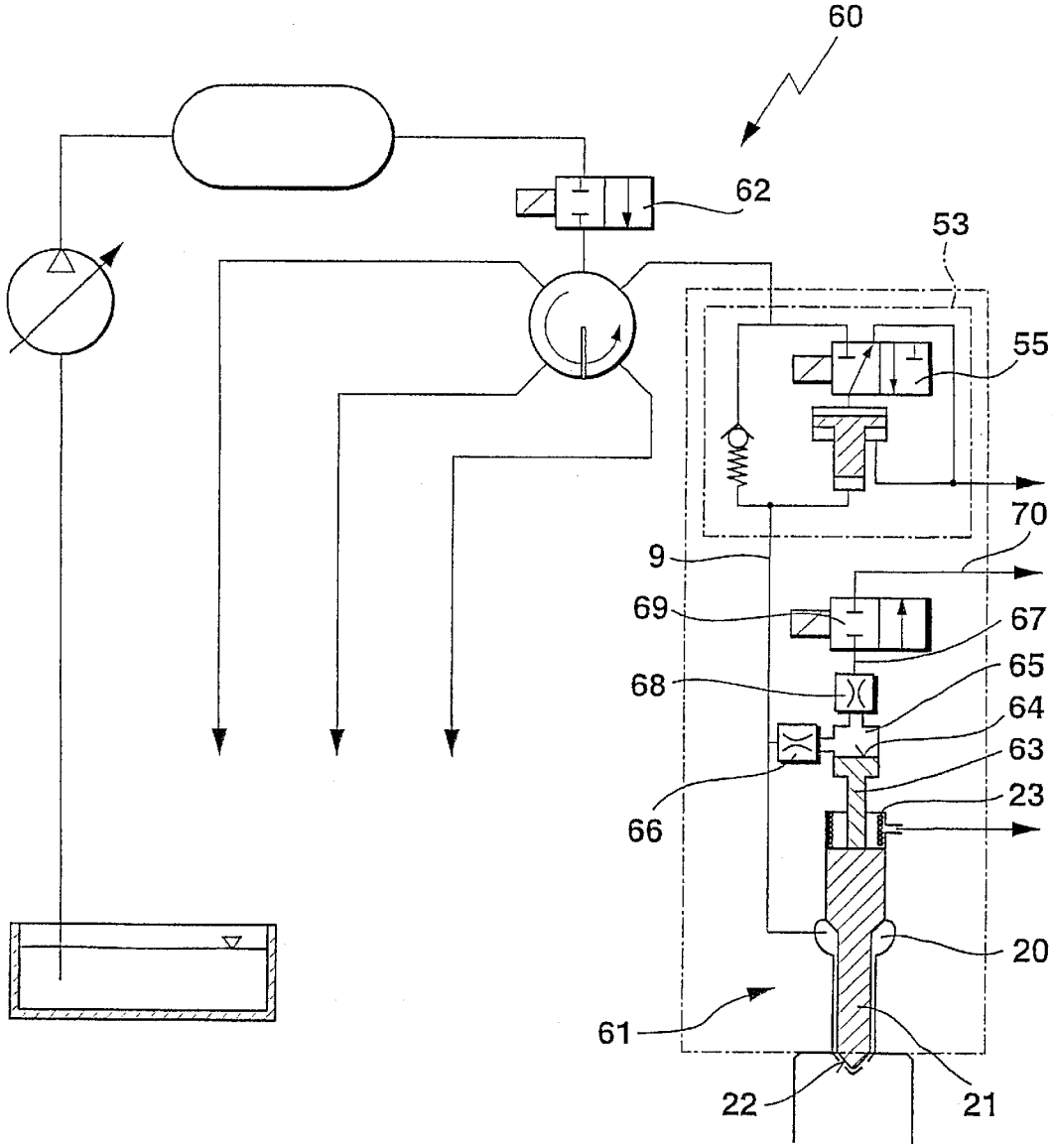
FIGS. 4*a* and 4*b* illustrate a fourth injection system with stroke-controlled injectors and with the modified local pressure booster unit for each injector.
Figure 4B:
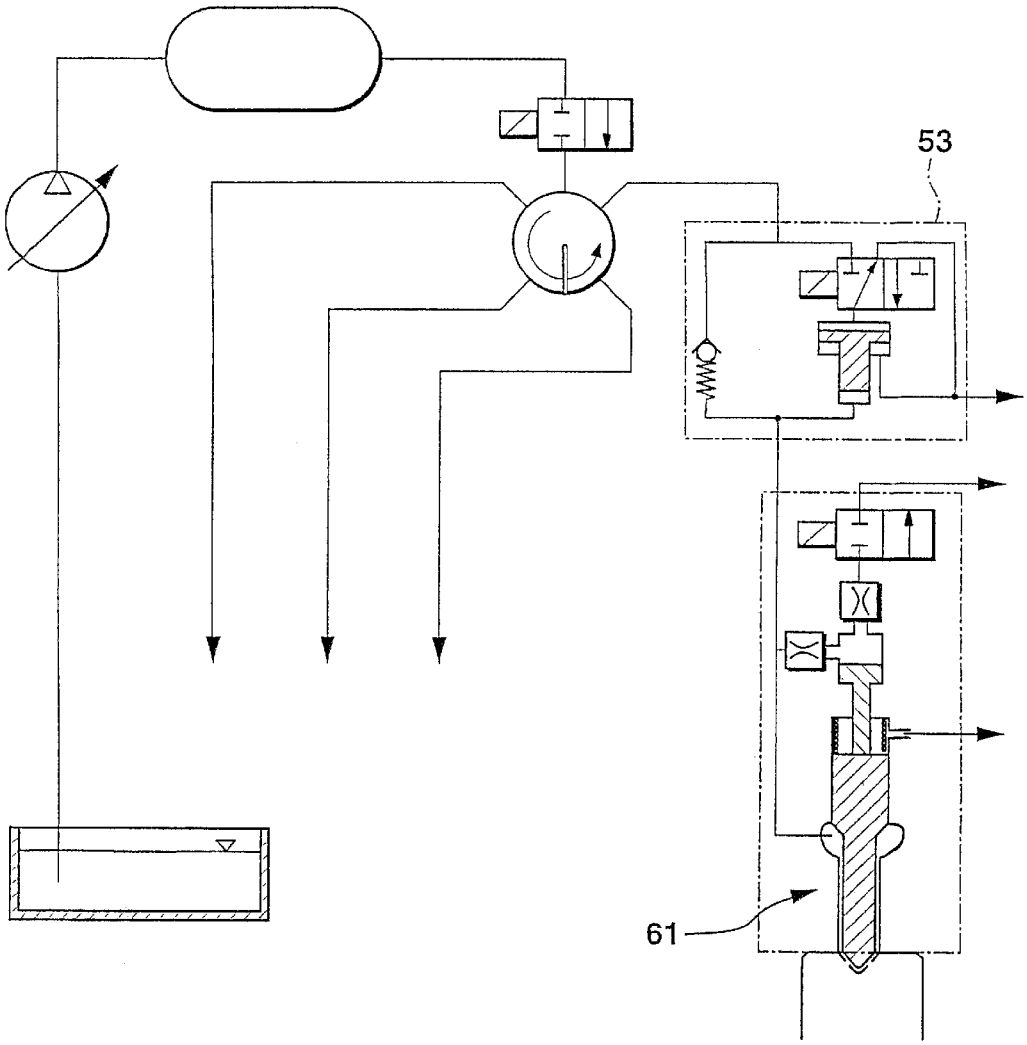

The injection system 60 shown in FIG. 4 differs from the injection system 50 in the use of stroke-controlled injectors 61 and in the embodiment of the central valve unit 62 as a 2/2-way valve. Beginning at the pressure-controlled injector 10 of FIG. 1, in the case of a stroke-controlled injector 61, the valve member 21 is engaged coaxially to the valve spring 23 by a pressure piece 63, which with its face end 64, remote from the valve sealing face 22, defines a control chamber 65. From the pressure line 9, the control chamber 65 has a fuel inlet with a first throttle 66 and a fuel outlet to a pressure relief line 67 with a second throttle 68, which can be controlled to leakage line 70 by a 2/2-way valve 69. Via the pressure in the control chamber 65, the pressure piece 63 is urged in the closing direction. Fuel at the lower or the higher fuel pressure constantly fills the nozzle chamber 20 and the control chamber 65. Upon actuation (opening) of the 2/2-way valve 69, the pressure in the control chamber 65 can be reduced, so that as a consequence, the pressure force in the nozzle chamber 20 exerted in the opening direction on the valve member 21 exceeds the pressure force exerted in the closing direction on the valve member 21. The valve sealing face 22 lifts from the valve seat face, and fuel is injected. The pressure relief process of the control chamber 65 and thus the stroke control of the valve member 21 can be varied by way of the dimensioning of the two throttles 66 and 68. The end of injection is initiated by re-actuation (closure) of the 2/2-way valve 69, which decouples the control chamber 65 from the leakage line 70 again, so that a pressure that can move the pressure piece 63 in the closing direction builds up again in the control chamber 65. The switchover of the fuel to either the lower or the higher fuel pressure is done for each injector 61 in the local pressure booster unit 53 by means of the valve unit 55. The pressure booster unit 53 can be located either inside the injector housing (FIG. 4*a*) or outside it (FIG. 4*b*).

In a fuel injection system 1 for an internal combustion engine, in which fuel at at least two differently high fuel pressures can be injected via injectors 10; 61 into the combustion chamber of the engine, parallel to a bypass line 19 a hydraulic pressure booster 11 is provided for generating the higher fuel pressure; the pressure booster 11 is actuatable and deactuatable via a valve unit 13. Since the pressure booster is not constantly in operation, and the losses from friction are also reduced, the efficiency is improved.

The foregoing relates to preferred exemplary embodiments of the invention, it being understood that other variants and embodiments thereof are possible within the spirit and scope of the invention, the latter being defined by the appended claims.

We claim:

1. In a fuel injection system (1; 40; 50; 60) for an internal combustion engine, in which fuel can be injected at at least two differently high fuel pressures into the combustion chamber of the internal combustion engine via injectors (10; 61), the improvement wherein, parallel to a bypass line (19; 45; 58), a hydraulic pressure booster (11; 42; 54) for generating the higher fuel pressure is provided, and the pressure booster (11; 42; 54) is actuatable and deactuatable via a valve unit (13; 13*a*; 44; 55), and the valve unit (13; 44; 55) is disposed upstream of the pressure booster (11; 42; 54).

2. The fuel injection system of claim 1, wherein the bypass line (19; 45; 58) is closed when the pressure booster (11; 42; 54) is activated.

3. The fuel injection system of claim 1, wherein the pressure booster (11) is provided centrally for all the injectors (10).

4. The fuel injection system of claim 1, wherein the pressure booster (42; 54) is provided locally for each of the injectors (10; 61 ) individually.

5. The fuel injection system of claim 1, at least one central pressure reservoir (51) is provided for storing the lower fuel pressure.

6. The fuel injection system of claim 1, wherein for distributing the fuel pressure to the various injectors (10; 61), a central distributor device (8) is provided.

7. The fuel injection system of claim 1, wherein the injectors (10) are embodied for pressure control.

8. The fuel injection system of claim 1, wherein the injectors (61) are embodied for stroke control.

9. The fuel injection system of claim 2, wherein the pressure booster (11) is provided centrally for all the injectors (10).

10. The fuel injection system of claim 2, wherein the pressure booster (42; 54) is provided locally for each of the injectors (10; 61 ) individually.

11. The fuel injection system of claim 2, at least one central pressure reservoir (51) is provided for storing the lower fuel pressure.

12. The fuel injection system of claim 2, wherein for distributing the fuel pressure to the various injectors (10; 61), a central distributor device (8) is provided.

13. The fuel injection system of claim 2, wherein the injectors (10) are embodied for pressure control.

14. The fuel injection system of claim 2, wherein the injectors (61) are embodied for stroke control.

15. The fuel injection system of claim 3, at least one central pressure reservoir (51) is provided for storing the lower fuel pressure.

16. The fuel injection system of claim 4, at least one central pressure reservoir (51) is provided for storing the lower fuel pressure.

17. In a fuel injection system (1; 40; 50; 60) for an internal combustion engine in which fuel can be injected at at least two differently high fuel pressures into the combustion chamber of the internal combustion engine via injectors (10; 61), the improvement wherein, parallel to a bypass line (19; 45; 58), a hydraulic pressure booster (11; 42; 54) for generating the higher fuel pressure is provided, and the pressure booster (11; 42; 54) is actuatable and deactuatable via a valve unit (13; 13*a*; 44; 55), and the valve unit (13*a*) is disposed downstream of the pressure booster (11).

18. The fuel injection system of claim 17, wherein the pressure booster (11) is provided centrally for all the injectors (10).

19. The fuel injection system of claim 17, wherein the pressure booster (42; 54) is provided locally for each of the injectors (10; 61) individually.

20. The fuel injection system of claim 17, at least one central pressure reservoir (51) is provided for storing the lower fuel pressure.

21. The fuel injection system of claim 17, wherein the bypass line (19; 45; 58) is closed when the pressure booster (11; 42; 54) is activated.

22. The fuel injection system of claim 17, at least one central pressure reservoir (51) is provided for storing the lower fuel pressure.

23. The fuel injection system of claim 17, wherein for distributing the fuel pressure to the various injectors (10; 61), a central distributor device (8) is provided.

24. The fuel injection system of claim 17, wherein the injectors (10) are embodied for pressure control.

25. The fuel injection system of claim 17, wherein the injectors (61) are embodied for stroke control.

26. The fuel injection system of claim 21, wherein the pressure booster (11) is provided centrally for all the injectors (10).

27. The fuel injection system of claim 21, wherein the pressure booster (42; 54) is provided locally for each of the injectors (10; 61) individually.

28. The fuel injection system of claim 21, at least one central pressure reservoir (51) is provided for storing the lower fuel pressure.

* * * * *